US008944859B2

(12) United States Patent
Kamor et al.

(10) Patent No.: US 8,944,859 B2
(45) Date of Patent: Feb. 3, 2015

(54) WIRE CLAMP FOR A WIRING DEVICE

(75) Inventors: Michael Kamor, N. Massapequa, NY (US); Adam Kevelos, Plainview, NY (US)

(73) Assignee: Leviton Manufacturing Company, Inc., Melville, NY (US)

( * ) Notice: Subject to any disclaimer, the term of this patent is extended or adjusted under 35 U.S.C. 154(b) by 130 days.

(21) Appl. No.: 13/701,166

(22) PCT Filed: Jun. 1, 2010

(86) PCT No.: PCT/US2010/001612

§ 371 (c)(1),
(2), (4) Date: Feb. 1, 2013

(87) PCT Pub. No.: WO2011/152811

PCT Pub. Date: Dec. 8, 2011

(65) Prior Publication Data

US 2013/0122759 A1 May 16, 2013

(51) Int. Cl.

| | |
|---|---|
| ***H01R 4/38*** | (2006.01) |
| ***H01R 11/14*** | (2006.01) |
| ***H01R 4/30*** | (2006.01) |
| ***H01R 4/44*** | (2006.01) |
| ***H01R 13/629*** | (2006.01) |
| ***H01R 13/64*** | (2006.01) |

(Continued)

(52) U.S. Cl.

CPC ..... *H01R 11/14* (2013.01); *H01R 4/304* (2013.01); *H01R 4/305* (2013.01); *H01R 4/38* (2013.01); *H01R 4/44* (2013.01); *H01R 13/629* (2013.01); *H01R 13/64* (2013.01); *H01R 4/34* (2013.01); *H01R 4/42* (2013.01)

USPC ..... 439/801; 174/51

(58) Field of Classification Search

CPC ..... H01R 13/652; H01R 25/006; H01R 4/34; H01R 4/64; H01R 4/301; H02G 3/0616

USPC ..... 439/107, 782, 801, 813; 174/51

See application file for complete search history.

(56) References Cited

U.S. PATENT DOCUMENTS

| | | | |
|---|---|---|---|
| 1,994,880 | A | 3/1935 | Wallbillich |
| 2,015,858 | A | 10/1935 | Leviton |
| 2,082,994 | A | 6/1937 | Wallbillich |

(Continued)

FOREIGN PATENT DOCUMENTS

| | | |
|---|---|---|
| DE | 2627313 | 1/1977 |
| DE | 4033074 A1 | 5/1991 |

OTHER PUBLICATIONS

PCT International Search Report and Written Opinion dated Mar. 21, 2011 for PCT/US2010/001612.

(Continued)

*Primary Examiner* — Thanh Tam Le

(74) *Attorney, Agent, or Firm* — Carter, DeLuca, Farrell & Schmidt, LLP

(57) ABSTRACT

A wire clamp is presented including a body having a face surface and an opposing back surface; a front end, a back end, and side ends; at least one tab positioned on an edge of the back end and an opening disposed substantially centrally on the body, the opening extending from the face surface to the back surface. The wire clamp also includes a plurality of gripping members positioned on edges of the side ends and a raised ridge extending a width of the clamp, the raised ridge adapted to grip a wire.

55 Claims, 4 Drawing Sheets

(51) Int. Cl.
*H01R 4/34* (2006.01)
*H01R 4/42* (2006.01)

(56) References Cited

U.S. PATENT DOCUMENTS

| | | | | | |
|---|---|---|---|---|---|
| 2,163,722 | A | | 6/1939 | Wallbillich | |
| 2,175,098 | A | | 10/1939 | Wertzheiser | |
| 2,201,743 | A | | 5/1940 | Petersen | |
| 2,201,751 | A | | 5/1940 | Wertzheiser | |
| 2,205,871 | A | | 6/1940 | Young | |
| 2,249,471 | A | | 7/1941 | Hamm et al. | |
| 2,506,212 | A | | 5/1950 | Grohsgal | |
| 2,952,831 | A | | 9/1960 | Ehrlich | |
| 3,006,003 | A | | 10/1961 | Johnson, Jr. | |
| 3,010,126 | A | | 11/1961 | Willcox | |
| 3,060,562 | A | | 10/1962 | Fransson | |
| 3,431,546 | A | | 3/1969 | Averill | |
| 3,439,315 | A | | 4/1969 | Hamel et al. | |
| 3,713,071 | A | | 1/1973 | Poliak et al. | |
| 3,740,613 | A | | 6/1973 | Strachan | |
| 3,793,607 | A | | 2/1974 | Smith et al. | |
| 3,904,266 | A | | 9/1975 | Fitzpatrick | |
| 3,944,314 | A | | 3/1976 | Weitzman et al. | |
| 3,945,711 | A | | 3/1976 | Hohorst et al. | |
| 4,060,305 | A | | 11/1977 | Poliak et al. | |
| 4,099,826 | A | | 7/1978 | Mazzeo et al. | |
| 4,146,289 | A | * | 3/1979 | Kirrish | 439/431 |
| 4,172,628 | A | | 10/1979 | Lingaraju | |
| 4,174,148 | A | * | 11/1979 | Obuch et al. | 439/782 |
| 4,261,402 | A | | 4/1981 | Stanaitis | |
| 4,900,259 | A | | 2/1990 | Ludwig et al. | |
| 5,181,310 | A | | 1/1993 | Josephson | |
| 5,266,039 | A | | 11/1993 | Boyer et al. | |
| 5,470,183 | A | * | 11/1995 | Swick | 411/368 |
| 5,658,108 | A | * | 8/1997 | Swick | 411/368 |
| 5,692,930 | A | | 12/1997 | Garver et al. | |
| 5,839,908 | A | | 11/1998 | Bonilla et al. | |
| 5,866,844 | A | | 2/1999 | Osterbrock et al. | |
| 6,082,942 | A | | 7/2000 | Swick | |
| 6,174,177 | B1 | * | 1/2001 | Auclair | 439/100 |
| 6,188,020 | B1 | | 2/2001 | Osterbrock et al. | |
| 6,263,922 | B1 | * | 7/2001 | Kerner et al. | 139/1 R |
| 6,293,812 | B1 | * | 9/2001 | Ewer et al. | 439/107 |
| 6,313,403 | B1 | | 11/2001 | Livingston et al. | |
| 6,743,029 | B1 | | 6/2004 | Greene et al. | |
| 6,814,629 | B1 | * | 11/2004 | Donfrancesco et al. | 439/782 |
| 6,861,189 | B1 | | 3/2005 | Greene et al. | |
| 6,864,422 | B1 | * | 3/2005 | Dionne et al. | 174/51 |
| 6,877,996 | B1 | | 4/2005 | Franks, Jr. | |
| 6,878,876 | B2 | | 4/2005 | Brant et al. | |
| 7,175,485 | B1 | | 2/2007 | Alderson et al. | |
| 7,446,666 | B2 | | 11/2008 | Fair et al. | |
| 7,589,639 | B2 | | 9/2009 | Fair et al. | |
| 7,667,616 | B2 | | 2/2010 | Fair et al. | |
| 7,806,736 | B2 | | 10/2010 | Alderson et al. | |
| 7,817,060 | B2 | | 10/2010 | Fair et al. | |
| 7,852,231 | B2 | | 12/2010 | Fair et al. | |
| 8,115,591 | B2 | | 2/2012 | Fair et al. | |
| 8,542,089 | B1 | | 9/2013 | Fair et al. | |
| 2007/0046487 | A1 | | 3/2007 | Fair et al. | |
| 2007/0046492 | A1 | | 3/2007 | Fair et al. | |
| 2007/0047233 | A1 | | 3/2007 | Wilson | |
| 2007/0047234 | A1 | | 3/2007 | Wilson et al. | |
| 2007/0047235 | A1 | | 3/2007 | Wilson | |
| 2007/0047236 | A1 | | 3/2007 | Wilson et al. | |
| 2010/0003865 | A1 | | 1/2010 | Alderson et al. | |
| 2010/0304596 | A1 | | 12/2010 | Ilkhanov | |
| 2011/0093094 | A1 | | 4/2011 | Goyal et al. | |

OTHER PUBLICATIONS

PCT International Preliminary Report on Patentability dated Dec. 4, 2012 for PCT/US2010/001612.

* cited by examiner

WIRE CLAMP FOR A WIRING DEVICE

BACKGROUND

1. Field of the Related Art

The present disclosure relates to wiring devices, and more particularly, to a wire clamp for a wiring device.

2. Background of the Related Art

Most countries utilize an alternating current based power source to power their electric grid infrastructure (referred to herein as an "AC source"). These systems can be either balanced or unbalanced and may include one or more phases, e.g., a three-phase AC source may include a first wire that provides a zero phase AC source, a second wire that provides a 120-degree phase AC source, a third wire that provides a 240-degree phase AC source and a return path (usually referred to as a "neutral" wire). The "neutral" wire may be used as a return path for the AC source supplied by the first, second and third wires. A wire includes (or is considered to be) a conductive path that can also be referred to as a "line." The terms "line," "conductive line" and "wire" are considered herein to be synonymous, and all include (or is equivalent to) a conductive path.

However, many AC wiring systems (e.g., those found in typical dwellings) also utilize an alternative return path called an earth ground. The earth ground, sometimes referred to as "the ground wire," is generally used as a safety feature by providing an alternative return path to the return path provided by the neutral wire. The earth ground may include several conductive rods that are sufficiently driven into the earth. A number of rods of sufficient length are used to provide a high current capacity conductive connection to the earth with sufficiently low impedance.

Many dwellings and office buildings use either a single-phase, two-phase, or three-phase AC source and/or some combination thereof. The AC source may be accessed by standardized connections (referred to as "plugs") that prevent a user from improperly connecting to an AC source, e.g., a three-phase AC plug cannot connect to a two-phase AC outlet. Additionally, many AC sources may selectively apply electricity to a load based upon whether a switch is turned on or off, e.g., a light switch.

To route, install and otherwise use AC electrical power, manufactures produce many different kinds of devices. These devices are referred to herein as wiring devices. Examples of wiring devices include electrical receptacles, switches, wiring boxes, ground fault circuit interrupters and the like. Typically, these wiring devices have a conductive strap or frame that can be grounded. By grounding the conductive strap, any AC source that unintentionally touches the conductive strap will return the AC current to the earth facilitating the detection of the unsafe condition while mitigating the risk of electric shock.

One method of grounding a wiring device is to ground the conductive frame or strap via a ground terminal. The ground terminal may be a piece of metal, such as a plate that includes a threaded opening for receiving a screw. The ground wire is stripped to expose the conductive layer (i.e., the outer insulating material is removed to expose the inner conductor). The stripped portion of the wire must then be bent or wrapped around the screw in some termination techniques. This is sometimes done using pliers and/or other tools. After the stripped portion of the wire is bent or wrapped around the screw's body, the screw can be tightened. The head of the screw secures the wire to the piece of metal grounding the ground terminal. Some prior art ground terminals have a limited torque capacity because the ground terminal is sometimes an extended thin piece of metal without additional structural support and are difficult to install because rigid wires can be difficult to bend or wrap around the screw.

Other wiring device terminals are also available for terminating wires. In addition to the ground terminals mentioned above, the other terminal types include load or line terminals, and/or neutral terminals. Together these terminals, depending on the mechanical configuration, may be wired using several different standard termination techniques. One such terminal is referred to as "side-wire" (sometimes referred to as "wrap-wire") terminals that are conducive to a termination technique with the same name. To terminate a wire using a side-wire terminal, the wire is initially stripped and the exposed portion of the wire is wrapped around a screw. The screw is then tightened causing the head of the screw to bind the exposed wire between the head of the screw and a metallic plate (e.g., a brass terminal).

Another type of wiring technique is referred to as "back-wire" (also referred to as "clamp-wire"). In back-wire terminals, a screw engages a metallic plate with a second metallic place (referred to as a clamp) to compress a wire therebetween. The metallic plate (or brass terminal) has a threaded opening and the clamp is a second metallic place that slides along the shaft of the screw between the brass terminal and the head of the screw. A stripped wire is placed between the two metallic plates and the screw is tightened to compress the wire.

Yet another type of wiring terminal technique is referred to as a "push-in" technique. Push-in terminals are terminals in which a small hole is available for insertion of a stripped wire. A #14 AWG solid-metal wire is initially stripped about five-eights of an inch from the cut end and the stripped portion is inserted into the hole. A locking mechanism presses down on the wire and maintains electrical contact with the wire for use by the wiring device. The locking mechanism prevents the wire from being pulled out of the hole. To release the wire, a screwdriver is used to press into a release slot releasing the wire.

SUMMARY

Objects and advantages of the present disclosure will be set forth in the following description, or may be obvious from the description, or may be learned through practice of the present disclosure.

The present disclosure provides a wire clamp including a body having: a face surface and an opposing back surface; a front end, a back end, and side ends; at least one tab positioned on an edge of the back end; an opening disposed substantially centrally on the body, the opening extending from the face surface to the back surface; and a raised ridge extending a width of the back surface of the wire clamp, the raised ridge adapted to grip and/or secure a wire.

The present disclosure provides a method of termination including electrically connecting a wire to a terminal of a wiring device via a wire clamp, the wire having a body having: a face surface and an opposing back surface; a front end, a back end, and side ends; at least one tab positioned on an edge of the back end; an opening disposed substantially centrally on the body, the opening extending from the face surface to the back surface; and a raised ridge extending a width of the back surface of the wire clamp, the raised ridge adapted to grip and/or secure a wire.

The present disclosure further provides a wiring device including a wire clamp having a body including: a face surface and an opposing back surface; a front end, a back end, and side ends; at least one tab positioned on an edge of the back end; an opening disposed substantially centrally on the body, the opening extending from the face surface to the back surface; and a raised ridge extending a width of the back surface of the wire clamp, the raised ridge adapted to grip and/or secure a wire.

The present disclosure further provides a wiring device including an opening for receiving a fastener; and a wire clamp in operable communication with the fastener for receiving a wire without piercing the wiring device.

The present disclosure further provides a wiring device including at least one tab protruding therefrom; and a wire clamp for engaging the at least one tab of the wiring device without piercing the wiring device.

The present disclosure further provides a wire clamp including a body having: a face surface and an opposing back surface; an opening disposed substantially centrally on the body, the opening extending from the face surface to the back surface; and a raised ridge extending a width of the back surface of the wire clamp, the raised ridge adapted to grip a wire.

The present disclosure further provides a wiring device including a wire clamp having a body including: a face surface and an opposing back surface; at least one tab positioned on an edge of the back end, the at least one tab cooperating with the wiring device to prevent rotation of the wire clamp; and an opening disposed substantially centrally on the body, the opening extending from the face surface to the back surface.

The present disclosure further provides a wiring device including an opening for receiving a fastener; and a wire clamp in operable communication with the fastener for gripping a wire without piercing the wiring device, the wire clamp including: an upwardly inclined tab for cooperating with the wiring device; and an opening disposed substantially centrally on the body.

The present disclosure further provides a wiring device including a body having a face surface and an opposing back surface; an opening disposed substantially centrally on the body, the opening extending from the face surface to the back surface; at least one tab cooperating with the wiring device to prevent rotation of the wire clamp, the at least one tab being an upwardly inclined tab; and a raised ridge extending a width of the back surface of the wire clamp, the raised ridge adapted to grip a wire.

Additional objects and advantages of the present disclosure are set forth in, or will be apparent to those skilled in the art from, the detailed description herein. Also, it should be further appreciated that modifications and variations to the specifically illustrated, referenced, and discussed steps, or features hereof may be practiced in various uses and embodiments of the present disclosure without departing from the spirit and scope thereof, by virtue of the present reference thereto. Such variations may include, but are not limited to, substitution of equivalent steps, referenced or discussed, and the functional, operational, or positional reversal of various features, steps, parts, or the like. Still further, it is to be understood that different embodiments, as well as different presently preferred embodiments, of the present disclosure may include various combinations or configurations of presently disclosed features or elements, or their equivalents (including combinations of features or parts or configurations thereof not expressly shown in the figures or stated in the detailed description).

BRIEF DESCRIPTION OF THE DRAWINGS

The foregoing and other objects, features, and advantages of the present disclosure will be apparent from the following more particular description of preferred embodiments as illustrated in the accompanying drawings, in which reference characters refer to the same parts throughout the various views. The drawings are not necessarily to scale, emphasis instead being placed upon illustrating principles of the present disclosure.

Various embodiments of the present disclosure will be described herein below with reference to the figures wherein.

While the above-identified drawing figures set forth alternative embodiments, other embodiments of the present disclosure are also contemplated, as noted in the discussion. In all cases, this disclosure presents illustrated embodiments by way of representation and not limitation. Numerous other modifications and embodiments may be devised by those skilled in the art which fall within the scope and spirit of the principles of the present disclosure.

DETAILED DESCRIPTION

The present disclosure proposes an externally guided wire clamp for aiding in the wire termination of a screw-type wiring device. The wire clamp may be guided by external geometry, thus, not requiring the terminal or surface of the wiring device it is attached to, to be pierced, as conventional designs. The wire clamp thus reduces the material usage and prevents contaminants from intruding into the wiring device.

The present disclosure further proposes an external clamp for a screw type termination wiring device that is formed from a sheet of metal. The wire clamp includes two tabs that interact with an external tab from an external part in order to ensure that the wire clamp does not rotate during installation of the wiring device. The tabs may be positioned on the exterior of the wiring device. The tabs may also act as a lead-in, so that the action of pushing a wire against the tab (of the wiring device) will lift it to allow the wire to access the clamping area. Additionally, a raised ridge spans or extends the width of the wire clamp to grasp/secure/anchor/constrain/snatch/embrace/hook/hold/receive a wire placed behind it. The raised ridge may be, for example, in one instance, a linear extrusion.

The present disclosure further proposes a gripping/locking feature (e.g., a raised ridge) that serves to grip the wire once the wire is received by the device/wire clamp and the screw is tightened. The raised ridge provides a sharp edge. This locking element can either be on the wire clamp, but can also be on the terminal surface of the wiring device. One benefit of having it on the wire clamp is that one gets the gripping/locking benefit regardless of whether a back wire or a side wire is performed. For example, if one side wires, i.e., wraps the conductor under the screw terminal head, the extrusion leaves a depression with sharp edges on the upper surface of the wire clamp, which acts to grip the wire as the screw head clamps down on the wire and forces it into the depression.

Figure 4:
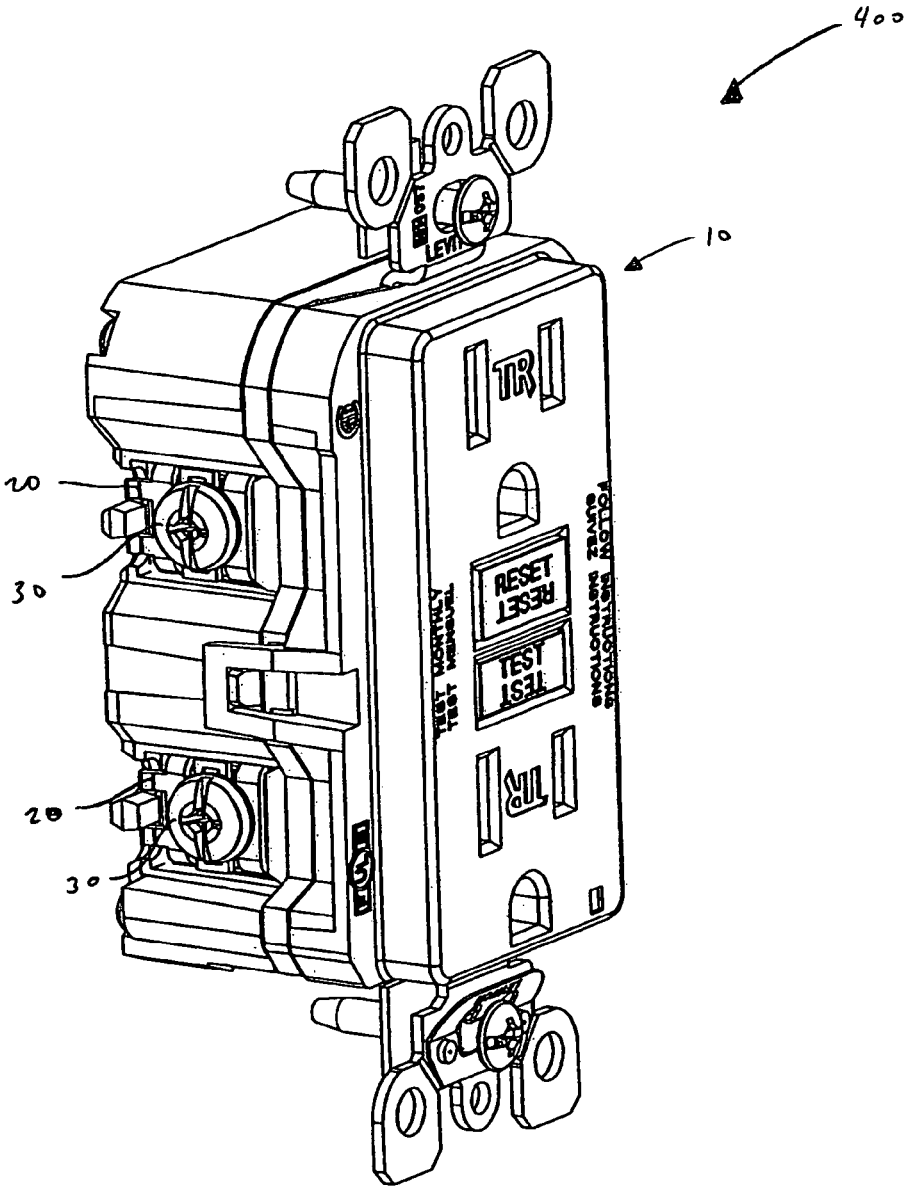
FIG. 4 is a schematic diagram of a perspective view of a wiring device including the wire clamp of FIG. 1, in accordance with the present disclosure.
Figure 5:
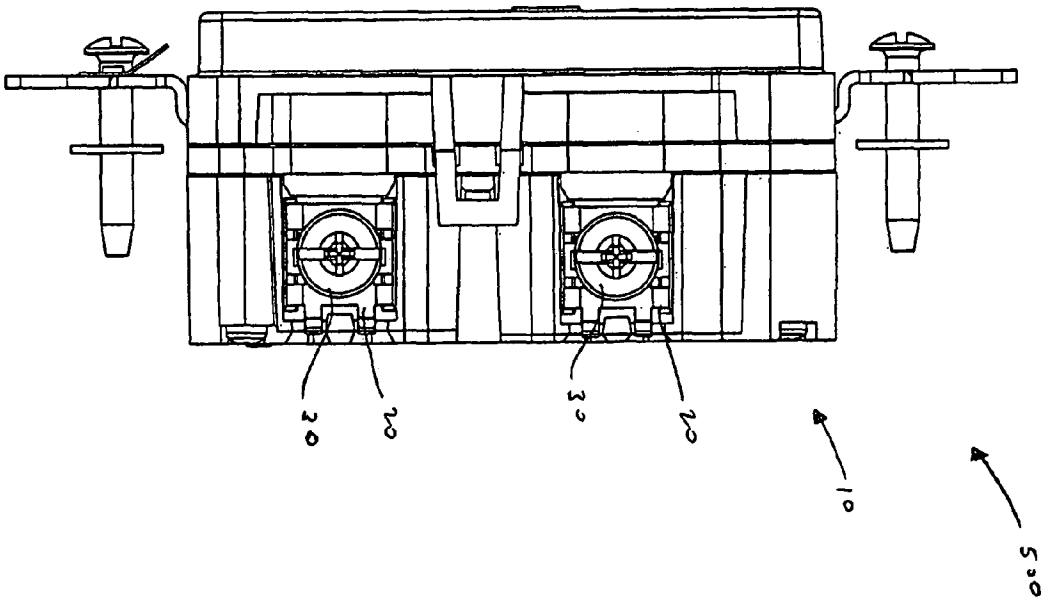
FIG. 5 is a side view of the wiring device of FIG. 4, in accordance with the present disclosure.

The present disclosure further proposes tabs (see element 26 of FIGS. 1 and 2) cooperating with a feature of the electrical device (see element 12 of FIG. 1) so as to prevent rotation of the wire clamp. Note that this can be accomplished by having: a) at least two tabs straddling a single feature on the device (as shown in FIGS. 1, 4 and 5); b) at least one tab being straddled by two features on the device; or c) two tabs each cooperating with a separate feature on the device where each tab/feature pair provides anti-rotation in the opposite direction of the other pair.

The present disclosure further proposes inclined/bent up tabs. Such tabs are bent upwards, away from the terminal surface of the device so that if the wire clamp is resting on the terminal surface, if a user elects to back wire he/she need only push the wire in from the back side and direct the conductor end under the bent up tab, resulting in the wire clamp being lifted away from the terminal surface as the user continues to push the conductor under the wire terminal. The user doesn't have to shake the device, orient the device in a manner to allow the wire clamp to move away from the terminal surface, or otherwise resort to prying the wire clamp away in order to get the wire under the wire clamp.

Embodiments will be described below while referencing the accompanying figures. The accompanying figures are merely examples and are not intended to limit the scope of the present disclosure.

Figure 1:
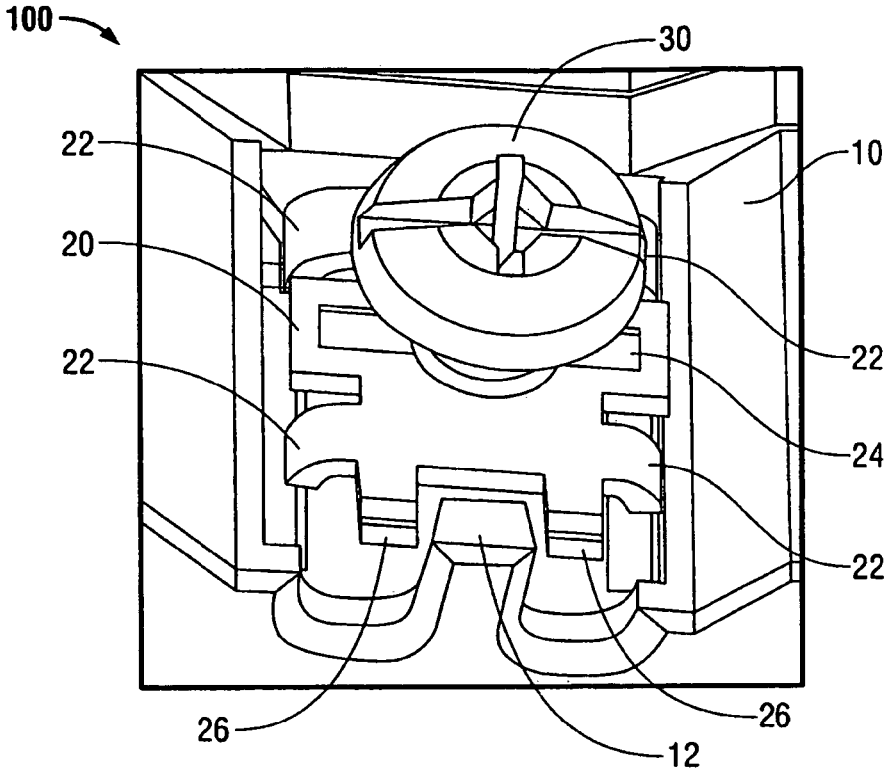
FIG. 1 is a schematic diagram of a front view of a wire clamp, in accordance with the present disclosure.

With reference to FIG. 1, there is presented a front view of a wire clamp, in accordance with the present disclosure.

The wiring device assembly 100 includes a wiring device 10, a wire clamp 20, and a fastener 30. The wire clamp 20 is positioned between the wiring device 10 and the fastener 30 in order to securedly fix the fastener 30 to the wiring device 10.

The wire clamp 20 includes a plurality of gripping members 22, a centrally disposed recess region 24, and two tabs 26. The wiring device also includes a tab 12. The two tabs 26 of the wire clamp 20 are slidably guided by the tab 12 of the wiring device 10 in order to establish a secure connection. Thus, the front surface (or face surface) of the wire clamp 20 is adapted to be a receiving region, whereas the back surface of the wiring clamp 20 is adapted to be a locking region, as further described below with reference to FIG. 2. The two tabs 26 may slidably engage with the wiring device 10, described below, such that the wire clamp 20 does not pierce the housing of the wiring device 10.

Wiring device 10 may include a conductive strap (not shown) that provides structural integrity and overall device grounding, e.g., such as by grounding the conductive strap to earth ground. The conductive strap may also be known as a frame or a yoke in the electrical industry. Grounding of conductive strap may be accomplished by connecting a ground wire to ground terminal (not shown). The ground terminal may be conductively connected to the conductive strap. The ground terminal and/or the conductive strap may be made from any suitable metals, alloys, or other materials such as aluminum, carbon, copper, gold, iron, manganese, nickel, palladium, platinum, steel, tin, tungsten, zinc and/or the like.

The terminal may include a conductive plate such as a metallic plate (not shown), which has a substantially planar shape. The conductive plate may have an opening formed therethrough that can grip/secure the fastener 30. For example, the metallic plate may include a threaded opening that can grip and/or secure a screw 30 with a head.

Wiring device 10 may include any number of different types of wiring modules for securing the conductive strap, as well as the fastener 30. For example, the wiring module may include a resettable circuit interrupting device, a ground fault circuit interrupter, an arc fault circuit interrupter, an immersion detection circuit interrupter, an appliance leakage circuit interrupter, an equipment leakage circuit interrupter, a circuit breaker, a contactor, a latching interrupting device, a fuse, a receptacle, a switch, a lighting control, an occupancy sensor, a button and/or the like. The wiring module may be selected based upon customer preferences, market conditions, or other preferences or conditions. For example, it may be more efficient to manufacture a common conductive strap, e.g., conductive strap and insert therein a module based upon orders from customers, such as orders for GFCI (ground fault circuit interrupter) devices, AC receptacles and the like.

Additionally, wiring device 10 may also include a recessed region, such as a wire guide (not shown). The wire (now shown) guide may grip an end of a wire. The guide wire may hold a wire substantially straight such that the wire is secured to the metallic plate while remaining straight. A wire that is secured to a terminal while remaining substantially straight is referred to herein as "straight-wire" installation. The terminal is capable of straight-wire installation as facilitated by the wire guide.

In operation, as screw 30 is tightened, the wire (not shown) is pressed between wire clamp 20 and the metallic plate. Eventually, the torquing of screw 30 will translate torque to the metallic plate when the wire is frictionally locked between wire clamp 20 and the metallic plate. When the torque is translated to the metallic plate, such as when the torque is applied in a clockwise motion from a top view of screw 30, the metallic plate experiences the torque as well. The wire clamp 20 is securedly fixed to the wiring device 10 by the two tabs 26, which are slidably received by the tab 12 of the wiring device 10. Additionally, the plurality of gripping members 22 secure the wire clamp 20 to the wiring device 10. It is also noted that the tabs 26 remain securedly positioned on the exterior portion of the wiring device 10. Also, after installation, the plurality of gripping members 22 remain securedly positioned on the exterior portion of the wiring device 10.

It also noted that the wire may be positioned on top portion of the wire clamp 20 or on the bottom portion of the wire clamp 20. If the wire is positioned on the top portion of the wire clamp 20, it is a side-wire connection, whereas if the wire is positioned on the bottom portion of the wire clamp 20, it is a back-wire connection. In the back-wire connection, the wire is secured in a substantially straight configuration, whereas in the side-wire position, the wire is secured in a curved configuration.

In continued operation, a screwdriver may engage the head of screw 30. The screwdriver may then be used to apply torque in a sufficient direction (in this example, clockwise from above) causing screw 30 to rotate clockwise. As screw 30 rotates clockwise, the head of the screw 30 approaches the wire clamp 20, which in turn approaches the wire. If screw 30 is turned enough, the wire becomes frictionally locked between the bottom portion of the wire clamp 20 and the metallic plate of the terminal. The wire clamp 20 utilizes an extrusion, as described below with reference to FIG. 2, in order to secure the wire in place.

Figure 2:
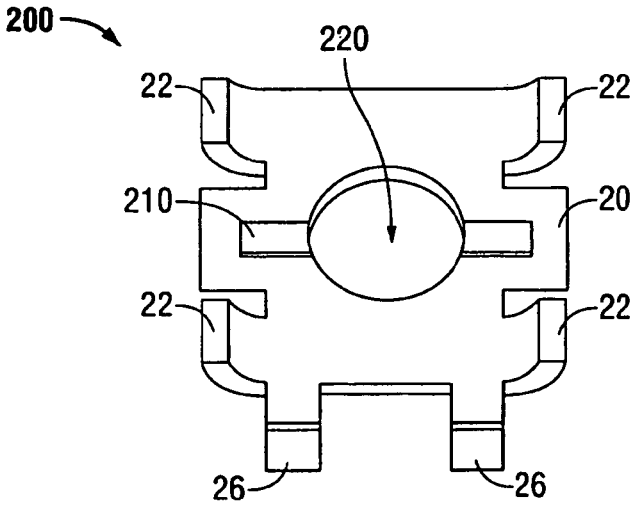
FIG. 2 is a schematic diagram of a back view of the wire clamp of FIG. 1, in accordance with the present disclosure.

With reference to FIG. 2, there is presented a back view of the wire clamp of FIG. 1, in accordance with the present disclosure.

The back view 200 of the wire clamp 20 depicts an extrusion 210 that spans or extends the width of the wire clamp 20 in order to grab/secure the wire (now shown). The back view 200 also illustrates the opening 220 through which the fastener 30 is gripped and/or secured to engage the wiring device 10.

The extrusion 210 may extend the entire length of the wire clamp 20. However, it is contemplated that the extrusion 210 may extend a portion of the length of the wire clamp 210. The extrusion 210 is illustrated as a straight line. However, the extrusion 210 may be formed in a plurality of different shapes, as well as a plurality of different sizes.

Additionally, there is illustrated two tabs 26 on the back end of the wire clamp 20. However, one skilled in the may contemplate using a number of tabs or a single tab. Additionally, the tabs 26 may be constructed from a plurality of different shapes and in a plurality of different sizes. The tabs 26 may also be curved tabs in order to engage the tab 12 of the wiring device 10. The curved tabs 26 may be configured to act as lead-in members for gripping the wire.

Figure 3A:
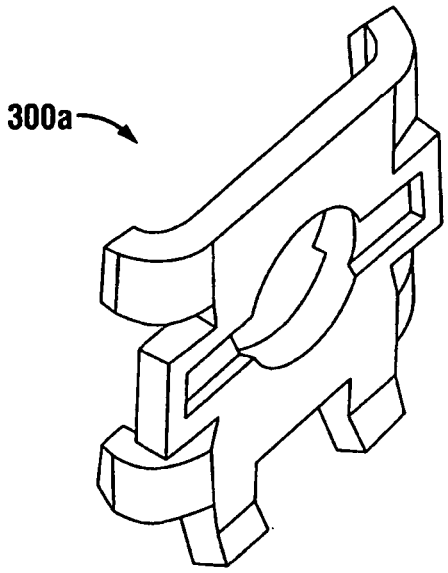
FIGS. 3A and 3B are schematic diagrams of perspective side views of the wire clamp of FIG. 1, in accordance with the present disclosure.
Figure 3B:
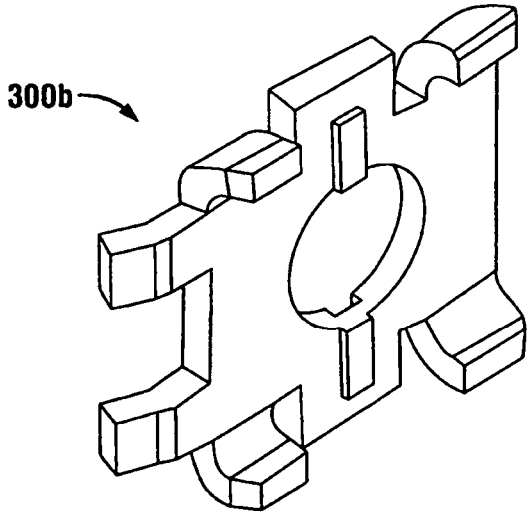

With reference to FIGS. 3A and 3B, there is presented perspective side views of the wire clamp of FIG. 1, in accordance with a second embodiment of the present disclosure.

The perspective view 300A depicts a front perspective view of the wire clamp 20 and the perspective view 300B depicts a back perspective view of the wire clamp 20. The recessed region 24 (see FIG. 1) and/or the extrusion 210 (see FIG. 2) may be considered a notch or groove to form the wire in a side-wire connection to provide for a better grip or secure connection. Thus, the gripping feature of the side-wire connection may be enabled on both sides of the wire clamp 20 (i.e., via the recessed region 24 (see FIG. 1) and/or via the extrusion 210 (see FIG. 2).

With reference to FIG. 4, there is presented a wiring device including the wire clamp of FIG. 1, in accordance with the present disclosure.

The perspective view 400 illustrates the wiring device 10 having a wire clamp 20 engaged to the wiring device 10 via a screw 30.

With reference to FIG. 5, there is presented a side view of the wire wiring device of FIG. 4, in accordance with the present disclosure.

The side view 500 illustrates the wiring device 10 having a wire clamp 20 engaged to the wiring device 10 via a screw 30.

It is anticipated that the wire clamp 20 is sold with the wiring device 10 in a single kit. However, one skilled in the art may contemplate the wire clamp 20 being sold separately from the wiring device 10.

Although exemplary systems and methods have been described in language specific to structural features and/or methodological acts, it is to be understood that the subject matter defined in the present disclosure is not necessarily limited to the specific features or acts described. Rather, the specific features and acts are disclosed as exemplary forms of implementing the methods, devices, systems, etc. of the present disclosure. The abstract and the title are not to be construed as limiting the scope of the present disclosure, as their purpose is to enable the appropriate authorities, as well as the general public, to quickly determine the general nature of the present disclosure.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art.

The invention claimed is:

1. A wire clamp configured to cooperate with a terminal surface of a wiring device, the wire clamp comprising:

a body having a front surface and an opposing back surface, an opening disposed substantially centrally on the body;

a plurality of gripping members extending from side portions of the body; and a tab extending from the body at an acute angle away from the terminal surface and having a tab surface configured to facilitate insertion of a wire between the body and the terminal surface; and a ridge positioned on the back surface of the body;

wherein the tab extending from the body is adapted and dimensioned to cooperate with a tab of the wiring device to prevent substantial rotation of the wire clamp.

2. The wire clamp of claim 1, wherein the terminal surface of the wiring device includes a plurality of recesses configured to at least partially receive the plurality of gripping members.

3. The wire clamp of claim 1, wherein the opening is configured to receive a terminal screw, the wire clamp and terminal screw are configured to establish a side-wire connection when the wire is positioned between the front surface of the wire clamp and a head of the terminal screw.

4. The wire clamp of claim 3, wherein the ridge forms a recess in opposed relation thereof on the front surface of the body, the recess formed on the front surface of the body by the ridge is adapted and dimensioned to establish a secure connection with the wire when the wire clamp and terminal screw establish the side-wire connection.

5. The wire clamp of claim 1, wherein the wire clamp and the terminal surface are configured to establish a back-wire connection when the wire is positioned between the back surface of the wire clamp and the terminal surface.

6. The wire clamp of claim 1, wherein the tab extending from the body further comprises two tabs which straddle the tab of the wiring device.

7. The wire clamp of claim 1, wherein the ridge extends a width of the wire clamp.

8. The wire clamp of claim 1, wherein the ridge extends linearly on the wire clamp.

9. The wire clamp of claim 1, wherein the ridge includes a raised edge for gripping the wire.

10. The wire clamp of claim 1, wherein the plurality of gripping members are configured to receive the wire and maintain the wire in a straight configuration.

11. The wire clamp of claim 1, wherein the plurality of gripping members are configured to cooperate with a geometry of the wire clamp to permit the wire clamp to be guided without piercing the terminal surface of the wire clamp.

12. A wiring device comprising:

an external wire guide configured to secure a conductor to a terminal surface of the wiring device; and a wire clamp configured to facilitate wire termination, the wire clamp including:

a body having a front surface and an opposing back surface, an opening disposed substantially centrally on the body;

a plurality of gripping members extending from side portions of the body; and a ridge positioned on the back surface of the body, the ridge forming a recess in opposed relation thereof on the front surface of the body;

wherein a tab extending from the body is adapted and dimensioned to cooperate with a tab of the wiring device to prevent substantial rotation of the wire clamp.

13. The wiring device of claim 12, wherein the terminal surface includes a plurality of recesses configured to at least partially receive the plurality of gripping members.

14. The wiring device of claim 12, wherein the opening is configured to receive a terminal screw, the wire clamp and terminal screw are configured to establish a side-wire connection when a wire is positioned between the front surface of the wire clamp and a head of the terminal screw.

15. The wiring device of claim 14, wherein the ridge forms a recess in opposed relation thereof on the front surface of the body, the recess formed on the front surface of the body by the ridge is adapted and dimensioned to establish a secure connection with the wire when the wire clamp and terminal screw establish the side-wire connection.

16. The wiring device of claim 12, wherein the wire clamp and the terminal surface are configured to establish a back-wire connection when a wire is positioned between the back surface of the wire clamp and the terminal surface.

17. The wiring device of claim 12, wherein the tab extending from the body further comprises two tabs which straddle the tab of the wiring device.

18. The wiring device of claim 12, wherein the ridge extends a width of the wiring device.

19. The wiring device of claim 12, wherein the ridge extends linearly on the wiring device.

20. The wiring device of claim 12, wherein the ridge includes a raised edge for gripping a wire.

21. The wiring device of claim 12, wherein the plurality of gripping members are configured to receive a wire and maintain the wire in a straight configuration.

22. The wiring device of claim 12, wherein the plurality of gripping members are configured to cooperate with a geometry of the wire clamp to permit the wire clamp to be guided without piercing the terminal surface of the wire clamp.

23. A wiring device comprising:

a housing having a plurality of terminals; and at least one of the plurality of terminals including a member at least partially disposed within the housing;

wherein the wiring device is configured for securing a wire to the member via a plate, wherein the plate comprises:

a body having a front surface and an opposing back surface, an opening disposed substantially centrally on the body;

a plurality of gripping members extending from side portions of the body;

a tab extending from the body at an acute angle away from the conductive member and having a surface being configured to facilitate insertion of the wire between the body and the conductive member; and a ridge positioned on the back surface of the body, the ridge forming a recess in opposed relation thereof on the front surface of the body;

wherein each of the plurality of gripping members includes a section for contacting a portion of the wiring device when attached thereto; and wherein the tab is adapted and dimensioned to cooperate with a tab of the wiring device to prevent substantial rotation of the plate.

24. The wiring device of claim 23, further comprising a plurality of recesses configured to at least partially receive the plurality of gripping members.

25. The wiring device of claim 23, wherein the ridge extends a width of the wiring device.

26. The wiring device of claim 23, wherein the ridge extends linearly on the wiring device.

27. The wiring device of claim 23, wherein the ridge includes a raised edge for gripping a wire.

28. The wiring device of claim 23, wherein the plurality of gripping members are configured to receive the wire and maintain the wire in a straight configuration.

29. The wiring device of claim 23, wherein the plurality of gripping members are configured to cooperate with a geometry of the wiring device to permit the wiring device to be guided without piercing a wiring device surface.

30. A wire clamp configured to cooperate with a terminal surface of a wiring device, the wire clamp comprising:

a body having a front surface and an opposing back surface, an opening disposed substantially centrally on the body;

a plurality of gripping members extending from side portions of the body; and a tab extending from the body at an acute angle away from the terminal surface and having a tab surface configured to facilitate insertion of a wire between the body and the terminal surface; and a ridge positioned on the back surface of the body;

wherein the terminal surface of the wiring device includes a plurality of recesses configured to at least partially receive the plurality of gripping members.

31. The wire clamp of claim 30, wherein the opening is configured to receive a terminal screw, the wire clamp and terminal screw are configured to establish a side-wire connection when the wire is positioned between the front surface of the wire clamp and a head of the terminal screw.

32. The wire clamp of claim 31, wherein the ridge forms a recess in opposed relation thereof on the front surface of the body, the recess formed on the front surface of the body by the ridge is adapted and dimensioned to establish a secure connection with the wire when the wire clamp and terminal screw establish the side-wire connection.

33. The wire clamp of claim 30, wherein the wire clamp and the terminal surface are configured to establish a back-wire connection when the wire is positioned between the back surface of the wire clamp and the terminal surface.

34. The wire clamp of claim 30, wherein the tab extending from the body is adapted and dimensioned to cooperate with a tab of the wiring device to prevent substantial rotation of the wire clamp; and wherein the tab extending from the body further comprises two tabs which straddle the tab of the wiring device.

35. The wire clamp of claim 30, wherein the ridge extends a width of the wire clamp.

36. The wire clamp of claim 30, wherein the ridge extends linearly on the wire clamp.

37. The wire clamp of claim 30, wherein the ridge includes a raised edge for gripping the wire.

38. The wire clamp of claim 30, wherein the plurality of gripping members are configured to receive the wire and maintain the wire in a straight configuration.

39. The wire clamp of claim 30, wherein the plurality of gripping members are configured to cooperate with a geometry of the wire clamp to permit the wire clamp to be guided without piercing the terminal surface of the wire clamp.

40. A wiring device comprising:

an external wire guide configured to secure a conductor to a terminal surface of the wiring device; and a wire clamp configured to facilitate wire termination, the wire clamp including:

a body having a front surface and an opposing back surface, an opening disposed substantially centrally on the body;

a plurality of gripping members extending from side portions of the body; and a ridge positioned on the back surface of the body, the ridge forming a recess in opposed relation thereof on the front surface of the body;

wherein the terminal surface includes a plurality of recesses configured to at least partially receive the plurality of gripping members.

41. The wiring device of claim 40, wherein the opening is configured to receive a terminal screw, the wire clamp and terminal screw are configured to establish a side-wire connection when a wire is positioned between the front surface of the wire clamp and a head of the terminal screw.

42. The wiring device of claim 41, wherein the ridge forms a recess in opposed relation thereof on the front surface of the body, the recess formed on the front surface of the body by the ridge is adapted and dimensioned to establish a secure connection with the wire when the wire clamp and terminal screw establish the side-wire connection.

43. The wiring device of claim 40, wherein the wire clamp and the terminal surface are configured to establish a back-wire connection when a wire is positioned between the back surface of the wire clamp and the terminal surface.

44. The wiring device of claim 40, wherein a tab extending from the body is adapted and dimensioned to cooperate with a tab of the wiring device to prevent substantial rotation of the wire clamp, and wherein the tab extending from the body further comprises two tabs which straddle the tab of the wiring device.

45. The wiring device of claim 40, wherein the ridge extends a width of the wiring device.

46. The wiring device of claim 40, wherein the ridge extends linearly on the wiring device.

47. The wiring device of claim 40, wherein the ridge includes a raised edge for gripping a wire.

48. The wiring device of claim 40, wherein the plurality of gripping members are configured to receive a wire and maintain the wire in a straight configuration.

49. The wiring device of claim 40, wherein the plurality of gripping members are configured to cooperate with a geometry of the wire clamp to permit the wire clamp to be guided without piercing the terminal surface of the wire clamp.

50. A wiring device comprising:

a housing having a plurality of terminals;

at least one of the plurality of terminals including a member at least partially disposed within the housing;

wherein the wiring device is configured for securing a wire to the member via a plate, wherein the plate comprises:

a body having a front surface and an opposing back surface, an opening disposed substantially centrally on the body;

a plurality of gripping members extending from side portions of the body;

a tab extending from the body at an acute angle away from the conductive member and having a surface being configured to facilitate insertion of the wire between the body and the conductive member;

a ridge positioned on the back surface of the body, the ridge forming a recess in opposed relation thereof on the front surface of the body; and a plurality of recesses configured to at least partially receive the plurality of gripping members;

wherein each of the plurality of gripping members includes a section for contacting a portion of the wiring device when attached thereto.

51. The wiring device of claim 50, wherein the ridge extends a width of the wiring device.

52. The wiring device of claim 50, wherein the ridge extends linearly on the wiring device.

53. The wiring device of claim 50, wherein the ridge includes a raised edge for gripping a wire.

54. The wiring device of claim 50, wherein the plurality of gripping members are configured to receive the wire and maintain the wire in a straight configuration.

55. The wiring device of claim 50, wherein the plurality of gripping members are configured to cooperate with a geometry of the wiring device to permit the wiring device to be guided without piercing a wiring device surface.

* * * * *